US005354342A

United States Patent [19]

Jenkins

[11] Patent Number: 5,354,342

[45] Date of Patent: Oct. 11, 1994

[54] STAIN RESISTANT MULTICOLOR TEXTURED CUT PILE CARPET

[75] Inventor: William G. Jenkins, Lexington, Va.

[73] Assignee: Burlington Industries, Greensboro, N.C.

[21] Appl. No.: 104,926

[22] Filed: Aug. 12, 1993

Related U.S. Application Data

[63] Continuation of Ser. No. 925,113, Aug. 6, 1992, abandoned, which is a continuation-in-part of Ser. No. 732,201, Jul. 19, 1991, Pat. No. 5,199,958, which is a continuation-in-part of Ser. No. 552,178, Jul. 12, 1990, Pat. No. 5,085,667, which is a continuation-in-part of Ser. No. 519,237, May 4, 1990, abandoned.

[51] Int. Cl.[5] ..... D06P 5/00

[52] U.S. Cl. ..... 8/481; 8/483; 8/485; 8/539; 8/680; 8/685

[58] Field of Search ..... 8/539, 481, 483, 680, 8/685, 485

[56] References Cited

U.S. PATENT DOCUMENTS

| | | | |
|---|---|---|---|
| 5,085,667 | 2/1992 | Jenkins | 8/539 |
| 5,155,178 | 10/1992 | Windley | 8/115.6 |
| 5,199,958 | 4/1993 | Jenkins et al. | 8/539 |

FOREIGN PATENT DOCUMENTS

| | | |
|---|---|---|
| 01/223908 | 9/1989 | Japan . |
| 01/260061 | 10/1989 | Japan . |
| 01/272885 | 10/1989 | Japan . |
| 272885 | 10/1989 | Japan . |

*Primary Examiner*—Paul Lieberman
*Assistant Examiner*—Margaret Einsmann
*Attorney, Agent, or Firm*—Nixon & Vanderhye

[57] ABSTRACT

Stain-resistant, multicolored cationic dyeable carpet fibers are space dyed with an acid dye or premetalized acid dye, heatset, then tufted together with undyed cationic dyeable nylon fibers into a carpet. The carpet is then overdyed with an acid dye or premetalized acid dye to selectively dye only the previously undyed cationic dyeable nylon fibers, without staining or discoloring the adjacent previously dyed fibers, resulting in a multicolored stain resistant carpet.

10 Claims, No Drawings

STAIN RESISTANT MULTICOLOR TEXTURED CUT PILE CARPET

CROSS-REFERENCE TO RELATED APPLICATIONS

This is a continuation/continuation-in-part of application Ser. No. 07/925,113, filed Aug. 6, 1992, now abandoned, which is a continuation-in-part of application Ser. No. 07/732,201 filed Jul. 19, 1991 now U.S. Pat. No. 5,199,958 which, in turn, is a continuation-in-part of earlier application Ser. No. 07/552,178 filed Jul. 12, 1990, now U.S. Pat. No. 5,085,667, which in turn, is a continuation-in-part of earlier application Ser. No. 07/519,237, filed May 4, 1990, abandoned.

This invention relates to textured, heathered, multicolored piece dyeable carpet made entirely of cationic dyeable nylon having the inherent stain resistance, lightfastness and ozone resistance of a yarn dyed cationic dyeable nylon using acid dyes in a multicolored carpet.

BACKGROUND OF THE INVENTION

Stain resistant nylon carpets enjoy significant market acceptance. Stain resistance is typically imparted to nylon by treating the fiber as a solid filament or in a carpet form by the topical application of a chemical finish as described in the following U.S. Pat. Nos. to Monsanto: U.S. Pat. Nos. 4,501,591; 4,592,940; and 4,839,212. The low acid pH necessary to fix this stain resistant finish has the adverse property of greatly altering the shade of the cationic dye which is normally used on this cationic dyeable fiber, precluding its use as a styling factor to obtain multicolor effects in subsequent carpet. However, by using cationic dyeable nylon, which has been previously dyed with acid dyes, in either a solid shade or, preferably, space printed to give multiple short spacings of color, this complication is overcome.

Nylon carpet fiber is generally classified as to type depending upon its receptivity to acid dyes and basic or cationic dyes. Cationic dyeable nylons contain sufficient $SO_3H$ groups or COOH groups within the polymer structure, which groups are receptive to cationic or basic dyes, to render the fiber dyeable by a cationic dye. Acid dyeable nylons are essentially conventional nylons, such as polyhexamethylene adipamide and polycaprolactam. Acid dyeable nylons vary as to receptivity type and are characterized as being weakly dyed with acid dyes, average dyed with acid dyes, or deeply dyed with acid dyes.

Cationic dyeable nylons generally exhibit inherent stain resistant properties, especially to acid-type stains, as compared to other nylon types used for carpet. Cationic dyeable nylons are dyeable with selected cationic dyes, but suffer from poorer lightfastness, especially in light shades, than do comparable shades dyed on acid dyeable nylon using monosulfonated or premetalized acid dyes. This has resulted in the under-utilization of cationic dyeable nylon as a carpet fiber. The fiber's inherently useful properties which otherwise make it attractive as a carpet fiber previously have not been fully realized.

Initial dyeing is accomplished using the space dyeing or intermittent dyeing technique in which the yarn within a given area or space is dyed a particular color, the color and spaces varying throughout the length of the yarn according to random or predetermined orders.

Dyeing carpet yarn is described in U.S. Pat. No. 4,206,735 which relates to a carpet prepared by space dyeing a polyester or polypropylene yarn then tufting the space dyed yarn with another yarn, undyed and having a susceptibility to a dye to which the polyester or polypropylene space dyeing yarn is not susceptible, followed by dyeing the undyed yarn taking care that the selective dyeability of the undyed yarn does not interfere with the previously space dyed yarn. Tak dyeing is used to provide coloration for nylon tufts and Tak dyeing is explained in U.S. Pat. No. 4,146,362.

Another type of space dyeing is described in U.S. Pat. No. 4,033,717 to Whitaker in which a continuous filament yarn is knit into a prefabric such as a tube or a sock, selectively dyed in a predetermined pattern using various colors, then deknitted, wound onto cones and heated to develop the color. This is also known as a knit/deknit process. When tufted into a carpet, the tufts of the space dyed yarn are arranged randomly or preferably in predetermined blocks or areas.

Research Disclosure 17913 (March 1979) uses the space dyed yarns of the Whitaker patent, combines them with undyed yarns, then overdyes to a different color to provide a carpet having different color combinations. Space dyed yarns may also be prepared using "resist" techniques to treat the fabric to "resist" the type of dye employed, as described in Jilla, U.S. Pat. No. 3,989,453.

Piece dyeing carpets using carpet pile made from two or more different classes of yarns, one yarn being susceptible to one type of dyeing and the other class of yarns susceptible to a different type of dye, is described in U.S. Pat. No. 3,439,999.

My earlier U.S. Pat. No. 5,085,667, the disclosure of which is hereby incorporated by reference, describes carpets made entirely of cationic dyeable nylon dyed an overall level shade with an acid or premetalized acid dye. These carpets enjoy the inherent stain resistance of cationic dyeable nylon and also exhibit high resistance to ozone and lightfastness.

My earlier application Ser. No. 07/732,201, the disclosure of which is hereby incorporated by reference, describes a stain-resistant multicolored carpet composed of cationic dyeable nylon yarn dyed with an acid dye or a premetalized acid dye and an acid dyeable nylon (undyed) tufted with the previously dyed cationic dyeable nylon into a carpet then overdyed with an acid dye to selectively dye the acid dyeable nylon yet neither dye nor stain the previously dyed cationic nylon fibers. This technique results in an attractive multicolor carpet although the acid dyeable nylon lacks the important, desirable stain resistant characteristic of cationic dyeable nylon.

DESCRIPTION OF THE INVENTION

The present invention provides an attractive multicolored carpet constructed entirely of cationic-dyeable nylon having the desired visual impact, amenable to a wide variety of styling and pattern changes, combined with the inherent stain resistance of cationic dyeable nylon.

The multicolor cationic dyeable nylon carpet yarn of the present invention, and tufted carpets made from it, are achieved utilizing solid or space dyed yarn prepared according to the techniques described in my U.S. Pat. No. 5,085,667, the disclosure of which is hereby incorporated by reference, which optionally is twisted or air entangled with another dyed cationic dyeable nylon, then heat set with dry heat at temperatures in the range of 160° C. to 220° C. A detailed discussion of heatsetting conditions and operational parameters is given below.

The resulting dyed yarn is pleated in carpet with an undyed cationic dyeable nylon and remains unstained in its original shade when carpet containing both dyed and undyed yarns is overdyed with acid or premetalized acid dyes to color the undyed yarn. The resulting carpet contains a multitude of colors resulting from the mixing of fibers of diverse shades, the physical arrangement and tufting of inherently stain resistant undyed fibers with other previously dyed fibers followed by overdyeing to selectively dye the undyed fibers only, without staining or discoloring the adjacent previously dyed fibers. The carpet is composed entirely of cationic dyeable nylon and takes full advantage of this fiber's inherent resistance to stains, particularly acid-type food stains.

This invention provides a procedure for preparing stain resistant carpet having an attractive multicolored appearance composed of cationic dyeable nylon.

A multicolored carpet is created according to this invention using cationic dyeable nylon yarn, which has been space dyed or printed to multiple colors with premetalized acid or acid dyes according to techniques outlined in my earlier U.S. Pat. No. 5,085,667. This multicolored yarn is combined, if desired, with other similarly dyed cationic dyeable nylon yarn, heatset in dry circulating air, tufted into a carpet, planted with a previously undyed cationic nylon yarn then overdyed with an acid or premetalized acid dye. Heatsetting closes the crystalline fiber structure of the thus treated cationic dyeable nylon rendering it resistant to dyeing or staining during the subsequent overdyeing process. During the overdyeing process the acid dye fixes to the undyed cationic dyeable nylon but not the previously dyed and heatset cationic dyeable nylon yarns leaving the multicolored spaced dyed yarn clear without staining or discoloring and distinct against a contrasting field of solid color yarns. Variations in the colors of the multicolored cationic dyeable nylon yarn, the shade of the background cationic dyeable nylon yarn, the relative amounts and positioning of the two shades of yarn, their construction into a carpet and other factors all provide attractive variations.

Heatsetting closes the crystalline structure of the nylon fibers imparting further stain resistance. Heatsetting is accomplished using times and temperatures consistent with the physical properties and characteristics of the nylon fibers employed. It is important that the heating temperature stay below the softening/melting point of the nylon as established by the fiber producer's data specific to fiber type. As an illustration, for type 66 nylon the softening/melting temperature is in the 240° C. to 255° C. range and a range of 208° C. to 212° C. for type 6 nylon. Preferably a maximum heating temperature is chosen to be about 20° C. below the softening-/melting point of the fiber used. Heating times are selected to avoid fiber yellowing leading to change of shade, fastness to light and reduced performance while the time the fibers are exposed to heat must be sufficient to close the fiber's crystalline structure. Heating times are related to heating temperatures and these two variables are selected such that during heatsetting operations the fiber reaches a temperature not exceeding its melting/softening point. Preferably heating times of about one minute, plus or minus 20 seconds at the temperature ranges noted above is sufficient to achieve bleach resistance while maintaining the other desired properties of fastness to light, resistance to acid-type stains, shade consistency and the like. Shorter times and lower temperatures reduce the effectiveness of the heatsetting treatment in closing the crystalline structure of the nylon fibers.

The nylon yarns are heat set under dry or very low moisture conditions in contrast to wet heatsetting procedures such as an autoclave or a Superba unit which use pressurized steam atmospheres. Dry air assures closing the fiber's crystalline structure while heatsetting in a moist environment opens the fiber's crystalline structure. Dry circulating air is preferred. Heated drums or rolls may be used but they tend to polish or partially remove crimp from the fibers.

Heatsetting is accomplished at temperatures in the range of 160° C. to 220° C. and preferably in a temperature range of about 195° to about 220° C. for a period of time of from about 40 seconds to about 80 seconds, generally about 1 minute. Type 66 cationic dyeable nylon is preferably heatset at temperatures in the range of about 195° C. to about 220° C. and for type 6 cationic dyeable nylon temperatures in the range of about 160° C. to about 180° C. Preferably the heatsetting is conducted in dry circulating air.

The preferred techniques for overdyeing the cationic dyeable nylon carpet include exhaust dyeing, pad/-steam continuous carpet dyeing and the like. Illustrative examples for dyeing procedures thought to be suited to the process of this invention are:

Continuous Dye Method

A dye bath is prepared as follows:

| Continuous Dye Method - A dye bath is prepared as follows: | | |
|---|---|---|
| Dye Solubilizer - | Thiodiglycol (Kromfax) - | 1.5 g/l |
| Dye Leveling Agent - | Sedgelev ACB - | 0.5 g/l |
| Defoamer- | Sedgekill AO - | 0.33 g/l |
| Premetalized acid dyestuff- | | X g/l |

(pH of bath adjusted to 6.0 with monosodium phosphate)

and applied to the cationic dyeable nylon carpet at a wet pickup of 400% based upon the weight of the carpet. For proper fixation, the carpet is steamed for 6–12 minutes then washed, extracted, treated with a fluorochemical soil repellant and dried.

Exhaust Dyeing an aqueous dyebath is prepared containing the required amount of premetalized acid dyestuff, the pH adjusted to 6.0 with monosodium phosphate and, optionally, up to 0.5% Irgasol SW, a weakly cationic complexing agent which retards the strike of the acid dye by complexing with the dye and then slowly releasing the dye to the fiber as the temperature rises, is added. The dyebath temperature, initially at 80° F., is increased at a rate of 2° F. per minute to 140° F. and held there for 15 minutes, then raised again at 2° F. per minute to 208°–212° F. Cationic dye able nylon is then exhaust dyed for 30 to 60 minutes or longer as needed to achieve the desired depth of shade.

What is claimed is:

1. A process of preparing a stain resistant, multicolored, cationic dyeable nylon carpet comprising the successive steps of:

(a) space dyeing a yarn of cationic-dyeable nylon fibers with an acid dye or a premetalized acid dye at a pH of about 4.0 to 6.5 and fixing the dye to the fibers, the cationic dyeable nylon yarn dyed to intermittently dye the yarn different colors along the length thereof;

(b) heat setting the space dyed fibers of step (a) by heating them under dry or very low moisture conditions to a temperature of about 160° C. to about 220° C. for a time sufficient to impart dye and stain resistance to the fibers;

(c) tufting the heat set yarns of step (b) and an undyed cationic dyeable nylon yarn into a carpet; and (d) dyeing the carpet prepared in step (c) with an amount of acid dye or premetalized acid dye sufficient to selectively dye only the previously undyed cationic dyeable nylon fibers and not the previously space dyed, heatset cationic dyeable nylon fibers, to produce a multicolored stain resistant carpet.

2. The process of claim 1, in which a premetalized dye is used in step (a), step (d) or both.

3. The process of claim 1, in which an acid dye is used in step (a), step (d) or both.

4. The process of claim 1, including the additional step of (e) applying a fluorocarbon soil repellant to the carpet.

5. The process of claim 1, in which the space dyed cationic-dyeable nylon fibers are fibers of nylon 66 and are heated at a temperature of about 195° C. to about 220° C. for a period of time of from about 40 seconds to about 80 seconds.

6. The process of claim 1 in which the cationic-dyeable nylon fibers are fibers of nylon 6 and are heated at a temperature of about 160° C. to about 180° C. for a period of time of from about 40 seconds to about 80 seconds.

7. A multicolored nylon textured cut pile carpet constructed entirely of cationic dyeable nylon fibers having improved stain resistance composed of space dyed, heatset cationic dyeable nylon dyed to two or more different shades with an acid or premetalized acid dye intermixed and tufted with a cationic dyeable nylon dyed to a background shade with a different shade of acid dye or premetalized acid dye.

8. The carpet of claim 7 where the nylon fibers are staple fibers.

9. The carpet of claim 8 wherein the fibers are in continuous filament form.

10. The carpet of claim 8 where the fibers are in yarn form.

* * * * *